US010113302B2

(12) United States Patent
Campomanes

(10) Patent No.: US 10,113,302 B2
(45) Date of Patent: Oct. 30, 2018

(54) TOOL RETENTION SYSTEM HAVING POCKETED WEDGE

(71) Applicant: Caterpillar Inc., Peoria, IL (US)

(72) Inventor: Patrick Simon Campomanes, Washington, IL (US)

(73) Assignee: Catepillar Inc., Deerfield, IL (US)

( * ) Notice: Subject to any disclaimer, the term of this patent is extended or adjusted under 35 U.S.C. 154(b) by 204 days.

(21) Appl. No.: 14/987,424

(22) Filed: Jan. 4, 2016

(65) Prior Publication Data

US 2017/0191247 A1 Jul. 6, 2017

(51) Int. Cl.
*E02F 9/28* (2006.01)

(52) U.S. Cl.
CPC ..... *E02F 9/2816* (2013.01); *E02F 9/2858* (2013.01)

(58) Field of Classification Search
CPC ..... E02F 9/2816; E02F 9/2833; E02F 9/2858
See application file for complete search history.

(56) References Cited

U.S. PATENT DOCUMENTS 4,433,496 A 2/1984 Jones et al.
5,410,826 A * 5/1995 Immel ..... E02F 9/2833 37/455
5,784,813 A 7/1998 Balassa et al.
7,516,564 B2 4/2009 Ruvang
8,434,248 B2 * 5/2013 Woerman ..... E02F 9/2825 37/456
8,458,931 B2 6/2013 Knight
8,720,088 B2 5/2014 Knight
2011/0072693 A1 3/2011 Knight
2011/0258891 A1 * 10/2011 Ruvang ..... E02F 9/2825 37/455
2013/0326919 A1 * 12/2013 Knight ..... E02F 9/2833 37/456
2014/0082977 A1 * 3/2014 Pilon ..... E02F 9/2833 37/453
2014/0366408 A1 12/2014 Campomanes
2015/0197921 A1 * 7/2015 Campomanes ..... E02F 9/2841 37/455
2017/0016212 A1 * 1/2017 Triginer Boixeda . E02F 3/8152
2017/0167117 A1 * 6/2017 Lombardo ..... E02F 9/2825

* cited by examiner

*Primary Examiner* — Jessica H Lutz
(74) *Attorney, Agent, or Firm* — Finnegan, Henderson, Farabow, Garrett & Dunner, LLP

(57) ABSTRACT

A system for connecting a tool to an implement may have a clamp with a first side, and a second side with teeth. The system may also have a wedge with a body configured to engage the second side of the clamp, a channel formed in the body, and a collar. The wedge may additionally have an elongated pocket formed in the body, a first ramp extending between the channel and an end of the elongated pocket, and a second ramp located at a point between a base end of the body and the first ramp. The first and second ramps may be inclined relative to an axis of the channel. The system may further have a slider with a toothed surface configured to engage the teeth of the clamp when the slider is in the channel, and a fastener threadingly engaged with the slider.

18 Claims, 4 Drawing Sheets

TOOL RETENTION SYSTEM HAVING POCKETED WEDGE

TECHNICAL FIELD

The present disclosure relates generally to a retention system and, more particularly, to a tool retention system having a pocketed wedge.

BACKGROUND

Earth-working machines, such as cable shovels, excavators, wheel loaders, and front shovels, include implements generally used for digging into, ripping, or otherwise moving earthen material. These implements are subjected to extreme abrasion and impacts that cause them to wear. To prolong the useful life of the implements, various ground engaging tools can be connected to the earth-working implements at areas experiencing the most wear. These ground engaging tools are replaceably connected to the implements using a retention system.

An exemplary retention system is disclosed in U.S. Pat. No. 8,458,931 of Knight that issued on Jun. 11, 2013 ("the '931 patent"). Specifically, the '931 patent discloses a fork-shaped tool body that fits over the front edge of an excavator bucket. A clamp passes through the body and the bucket, and a wedge is inserted alongside the clamp to hold the clamp in position. The wedge has a U-shaped axial recess, and a threaded rod is received within the recess and oriented at an angle relative to the clamp. A threaded block is mounted to the rod, and the rod is rotatable to move the block along the rod. The block includes teeth that engage the clamp upon insertion of the wedge into the body, such that as the rod is rotated and the block moves along the rod, the wedge is forced further into the body. As the wedge is forced further into the body, the clamp is urged tighter against the body and the bucket. With this configuration, the fork-shaped tool body can be removably connected to the excavator bucket by rotation of the rod.

Although acceptable for some applications, the retention system of the '931 patent may be less than optimal. In particular, the retention system may be limited in travel by a length of the rod and clearances required inside the system for assembly purposes. Specifically, in order to engage the teeth of the block with the teeth of the clamp, peaks of the block teeth must first pass over peaks of the wedge teeth during wedge insertion. When this happens, the wedge is forced away from the clamp. The extra clearance consumed by the wedge at this time must first be taken up by rotation of the rod, before the rod rotation functions to tighten the system. In some embodiments, this may leave little rod rotation remaining for use in tightening the system. In addition, during removal of the wedge, the block teeth may remain engaged with the clamp teeth even after the rod has been rotated in a loosening direction, making subsequent removal of the wedge difficult.

Another exemplary retention system is disclosed in U.S. Patent Application 2015/0197921 of Campomanes that published on Jul. 16, 2015 ("the '921 publication"). In this retention system, a pocket is formed at an end of a wedge channel. The pocket is an inclined area of increased depth that is configured to receive a corresponding slider block as the slider block is moved deeper into the wedge. This may allow teeth of the slider block to drop out of meshed engagement, which may be helpful during assembly. In addition, it may allow the wedge to be inserted a greater distance before engagement with the clamp occurs, thereby providing for an enhanced connection.

While the pocket of the '921 publication may result in easier assembly and an improved connection, it may still be less than optimal. In particular, the slider block may still be pulled by gravity into premature connection with the clamp during assembly. Additionally, gravity may inhibit the slider block from disengaging from the clamp during disassembly, even though clearance may be available in the pocket.

The disclosed tool retention system and wedge are directed to overcoming one or more of the problems set forth above.

SUMMARY

According to one exemplary aspect, the present disclosure is directed to a wedge for a tool retention system. The wedge may include a body having a tip end and an opposing base end that is wider than the tip end, and a channel formed in the body and extending from the base end to the tip end. The wedge may also include an elongated pocket formed in the body at the tip end that is open to the channel, and a ramp located in the body and extending between the channel and an end of the elongated pocket. The ramp may be inclined relative to an axis of the channel.

According to another exemplary aspect, the present disclosure is directed to a system for use in retaining a tool connected to an implement. The system may include a clamp configured to pass through openings in the implement and tool. The clamp may have a first side configured to engage the implement and the tool, and a second side with teeth oriented away from the implement and the tool. The system may also include a wedge configured to pass through the openings in the implement and the tool. The wedge may have a body with a flat outer surface configured to engage the second side of the clamp and extending between a tip end and an opposing base end that is wider than the tip end, and a curved outer surface located opposite the flat outer surface and configured to engage the implement and the tool. The wedge may also have a channel formed in the body and extending from the base end to the tip end, and a collar dividing the channel into a head section and a shank section. The wedge may additionally have an elongated pocket formed in the body at the tip end that is open to the shank section of the channel, a first ramp located in the body and extending between the channel and an end of the elongated pocket, and a second ramp located at a point between the base end of the body and the first ramp. The first and second ramps may be inclined relative to an axis of the channel. The system may further include a slider configured to move between the channel and the elongated pocket and having a toothed surface configured to engage the teeth of the clamp when the slider is in the channel, and a fastener having a head located in the head section of the channel and a shank located in the shank section of the channel. The fastener may be threadingly engaged with the slider.

DETAILED DESCRIPTION

Figure 1:
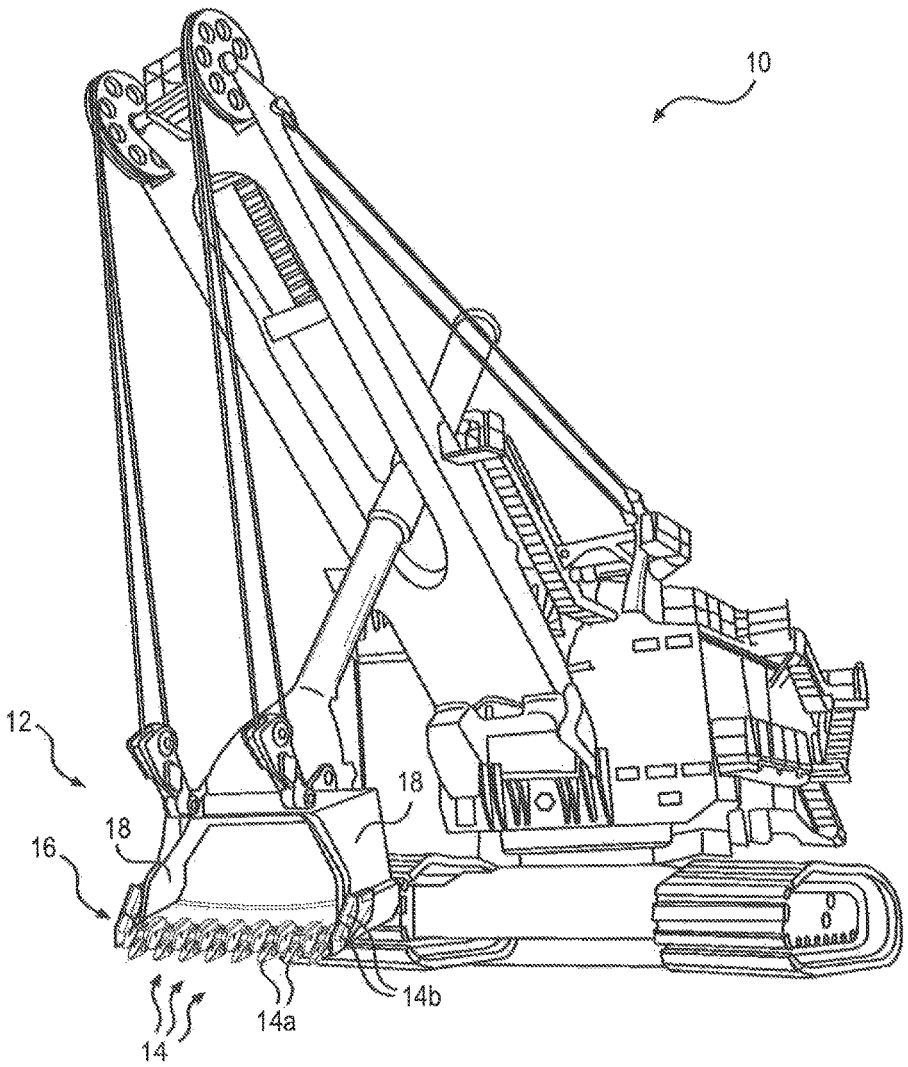
FIG. 1 is an isometric illustration of an exemplary disclosed machine.

FIG. 1 illustrates a mobile machine 10 having a work implement 12 operatively connected at a leading end. In the disclosed embodiment, machine 10 is a shovel (e.g., a rope or cable shovel). It is contemplated, however, that machine 10 may embody another type of mobile or stationary machine known in the art, for example a hydraulic mining shovel, an excavator, a motor grader, a dragline, a dredge, or another similar machine. Machine 10 may be configured to use work implement 12 to move material, such as earthen material, during completion of an assigned task. Although shown as being located at the leading end of machine 10, it is contemplated that work implement 12 could alternatively or additionally be located at a midpoint or trailing end of machine 10, if desired.

Work implement 12 may embody any device used to perform the task assigned to machine 10. For example, work implement 12 may be a shovel (shown in FIG. 1), a blade, a bucket, a crusher, a grapple, a ripper, or any other material moving device known in the art. In addition, although connected in the embodiment of FIG. 1 to lift, curl, and dump relative to machine 10, work implement 12 may alternatively or additionally rotate, swing, pivot, slide, extend, open/close, or move in another manner known in the art.

Work implement 12 may be equipped with one or more ground engaging tools (GET) 14 located around an opening thereof. For example, the disclosed shovel is shown as being provided with multiple tooth assemblies 14*a* that are spaced apart along the length of a cutting edge 16, and multiple wing shrouds 14*b* that are located at vertical sidewalls 18 of the shovel. It is contemplated that GET 14 could take any other form known in the art, for example a fork configuration, a chisel configuration, a hook configuration, or a blunt-end configuration. Other configurations may also be possible.

Figure 2:
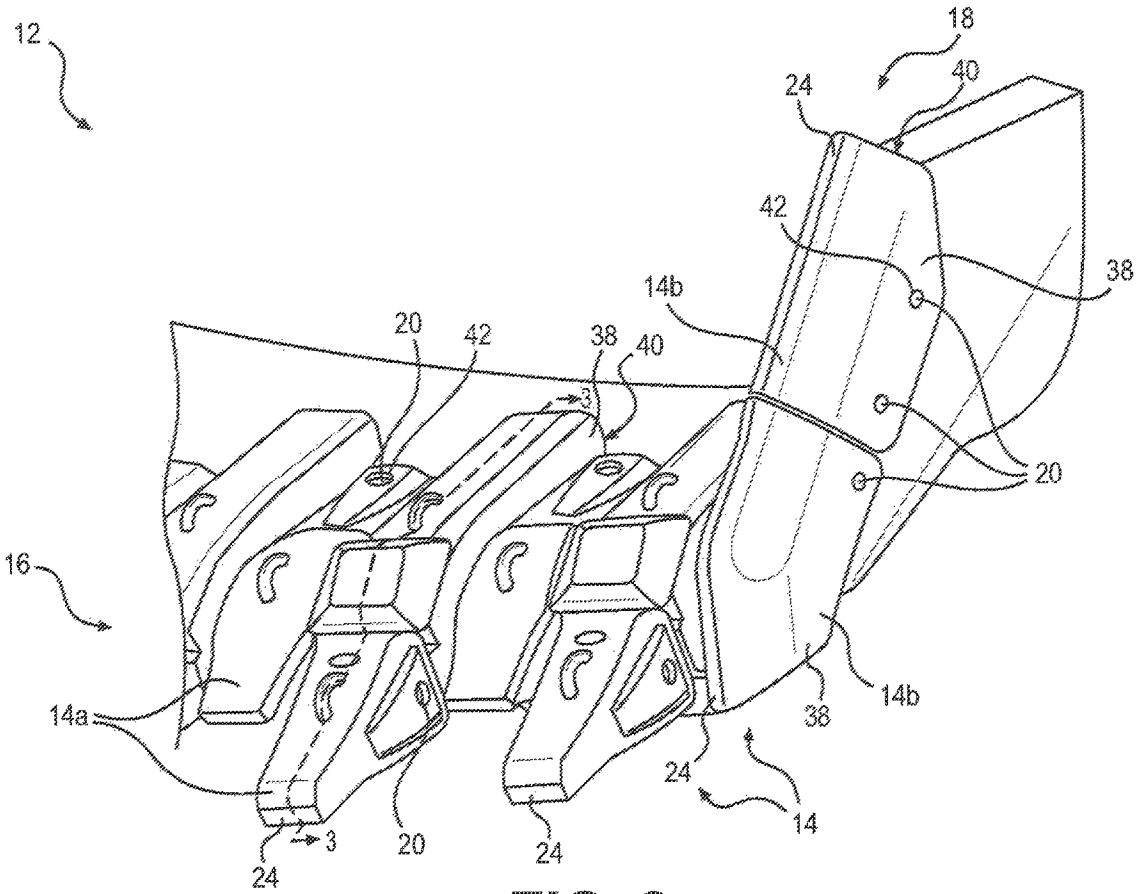
FIG. 2 is an isometric illustration of an exemplary disclosed tool retention system that may be used in conjunction with the machine of FIG. 1.
Figure 3:
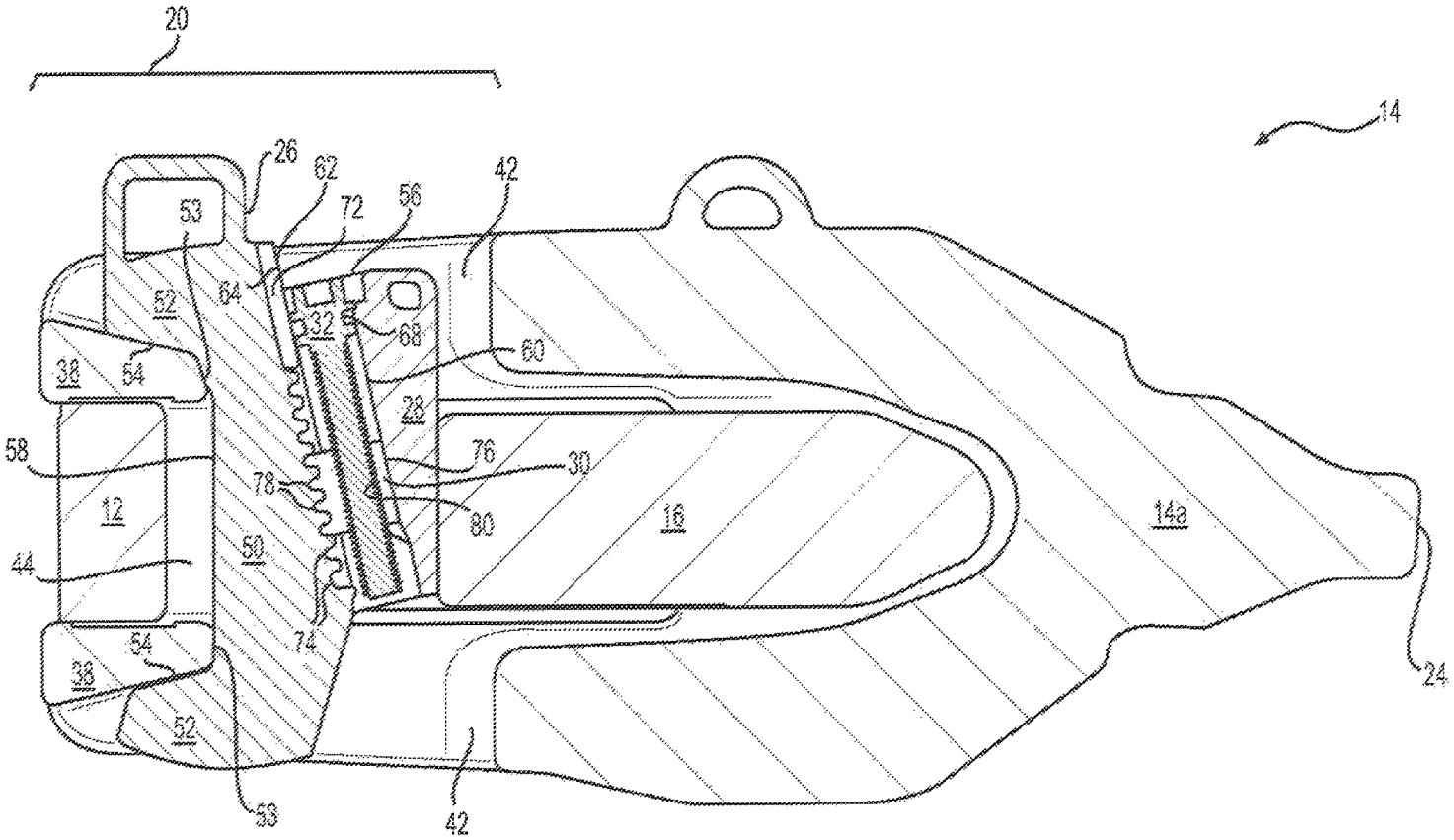
FIG. 3 is a cross-sectional illustration of an exemplary portion of the tool retention system of FIG. 2.

As shown in FIGS. 2 and 3, each GET 14 may include legs 38 that extend in a direction away from an external end 24. Legs 38 may be spaced apart from each other to form an opening 40 therebetween that is large enough to receive cutting edge 16 and/or vertical sidewall 18 of work implement 12. An aperture 42 may be formed within each leg 38, and apertures 42 may be generally aligned with each other and with a corresponding aperture 44 (shown only in FIG. 3) in work implement 12. In the disclosed embodiments, apertures 42, 44 are generally cylindrical or elliptical at a leading end and flat an opposing trailing end, although other contours may also be utilized.

Each GET 14 may be removably connected to work implement 12 by way of a retention system 20. In this manner, each GET 14 may function as a wear piece at the attachment location, and be periodically replaced when worn or misshapen beyond a desired or effective amount. Retention system 20 may be configured to pass through and engage the inner surfaces of apertures 42 and 44, thereby locking GET 14 to work implement 12. It is contemplated that the same retention system 20 may be used for all GET 14 or that a different retention system 20 may be used for different types of GET 14, as desired.

The exemplary retention system 20 shown in FIG. 3 includes multiple components that interact to clamp an associated GET 14 (e.g., each tooth assembly 14*a*) in a removable manner to cutting edge 16 of work implement 12. Specifically, retention system 20 includes a clamp 26, a wedge 28, a slider 30, and a fastener 32. As will be described in more detail below, clamp 26 may pass through GET 14 (e.g., through apertures 42 of tooth assembly 14*a*) and through work implement 12 (e.g., through aperture 44), and wedge 28 may be used to hold clamp 26 in place. Slider 30 may be connected to wedge 28 by fastener 32 and configured to selectively engage clamp 26. Fastener 32 may then be rotated relative to slider 30 to cause wedge 28 to be pulled into apertures 42 and 44. As wedge 28 is pulled further into apertures 42 and 44, wedge 28 may push clamp 26 forward (e.g., to the right in the perspective of FIG. 3) with a greater force, thereby maintaining a desired connection of tooth assembly 14*a* to cutting edge 16 of work implement 12.

As also shown in FIG. 3, clamp 26 may have a middle section 50 and spaced-apart arms 52 located at opposing ends of middle section 50. Clamp 26 may be inserted through apertures 42 of GET 14 and aperture 44 of work implement 12, with arms 52 oriented rearward away from tooth assembly 14*a* and toward legs 38. In some embodiments, inner surfaces 53 and 54 of arms 52 may taper outward and be configured to engage outer surfaces of tooth assembly 14*a*. With this configuration, as clamp 26 is forced rearward away from cutting edge 16 by insertion of wedge 28 through apertures 42 and 44, arms 52 may generate greater inward forces (i.e., toward implement 12) that push legs 38 of tooth assembly 14*a* together to implement 12 therebetween.

Middle section 50 of clamp 26 may have a generally flat inner surface 58 between arms 52 that is configured to match the profile of apertures 42 and/or 44 when assembled, and a generally flat outer surface 62 opposite inner surface 58 that is inclined rearward toward implement 12 relative to an axis of apertures 42, 44. As clamp 26 is pushed by wedge 28 away from cutting edge 16 (i.e., toward legs 38), inner surface 58 of middle section 50 may engage the flat inner end surfaces of apertures 42 and/or 44.

Clamp 26 may be provided with a longitudinal channel 72 formed within outer surface 62. Channel 72 may be divided into a first portion and a second portion. The first portion of channel 72 may simply provide clearance for a head of fastener 32 and/or corresponding tools used to rotate fastener 32, while the second portion of channel 72 may be provided with teeth 74. As will be described in more detail below, teeth 74 may be configured to mesh with corresponding teeth of slider 30, and be used to pull wedge 28 into further engagement with apertures 42, 44.

Wedge 28 may be located immediately adjacent outer surface 62 of clamp 26 (e.g., at a side of clamp 26 opposite arms 52 and closer to cutting edge 16), and have a generally flat inclined inner surface 64 configured to slide against outer surface 62 of clamp 26. Wedge 28 may also have an outer surface 70 that is shaped (see FIG. 4) to match the cylindrical profile of apertures 42, 44. With this arrangement, as wedge 28 is pulled further into apertures 42, 44, clamp 26 may be forced more away from cutting edge 16 (i.e., against the opposing flat end surfaces of apertures 42, 44).

An elongated channel 60 may be formed within inner surface 64 of wedge 28, and a collar 68 may be located to divide channel 60 lengthwise into a first section and a second section. The first section of channel 60 may generally face the first section of channel 72 in clamp 26, while the second section of channel 60 may generally face the second section of channel 72. The first section of channel 60 may be configured to receive the head of fastener 32, while the second section may be configured to receive a threaded shank of fastener 32 and also slider 30. Collar 68 may be configured to provide a reaction and axial support point for the head of fastener 32. In some embodiments, collar 68 may be notched (shown in FIG. 4) to facilitate quick assembly or disassembly of fastener 32 from wedge 28.

In the disclosed embodiment, channel 72 and collar 68 may both be generally circular in cross-section, and have an open side oriented toward clamp 26. It is contemplated, however, that channel 72 and/or collar 68 may have another shape, if desired, such as a square or rectangular cross-section. In some embodiments, a cylindrical depression 56 may be formed within an axial end of collar 68 (i.e., the end facing the first portion of channel 60) that is configured to seat the head of fastener 32 and thereby inhibit unintentional removal of fastener 32.

Slider 30 may be semi-cylindrical, having a smooth outer surface 76 configured to slide within channel 60 of wedge 28, and an opposing toothed surface 78 configured to mesh with teeth 74 of clamp 26. Slider 30 may also include a threaded bore 80 that is oriented axially and configured to receive the threaded shank of fastener 32. With this configuration, as fastener 32 is rotated within collar 68, slider 30 may be caused to slide along the length of channel 60.

Fastener 32 may be configured to adjustably join slider 30 with wedge 28. In particular, as the head of fastener 32 is rotated by a service technician, the threaded shank of fastener 32 may interact with bore 80 of slider 30 to cause linear translation of slider 30 within channel 60. Slider 30, having toothed surface 78 intermeshed with teeth 74 of clamp 26, however, may be fixed relative to system 20. Accordingly, the translating motion of slider 30 may be transferred to wedge 28. In other words, as fastener 32 is rotated within slider 30, wedge 28 may be pulled into or pushed out of apertures 42, 44, depending on the direction of fastener rotation. And as described above, the linear motion of wedge 28 may correspond with the clamping forces generated by clamp 26 on GET 14 (e.g., on tooth assembly 14*a*) and work implement 12.

Figure 5:
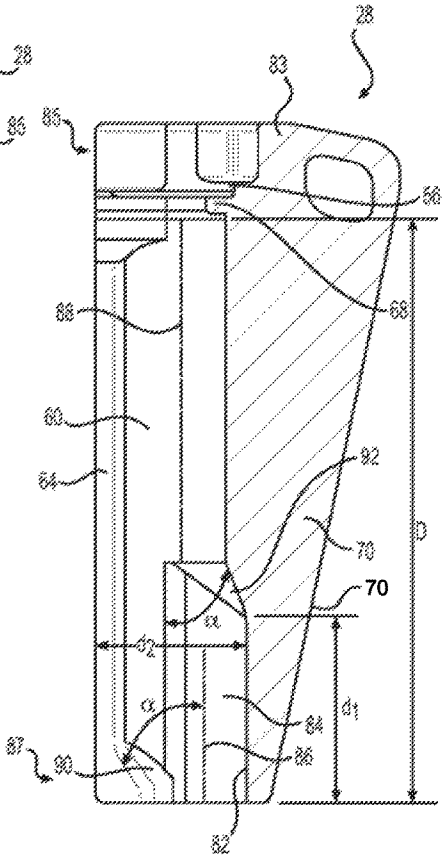
FIGS. 4 and 5 are isometric and cross-sectional illustrations, respectively, of a portion of the tool retention system shown in FIG. 3.
Figure 4:
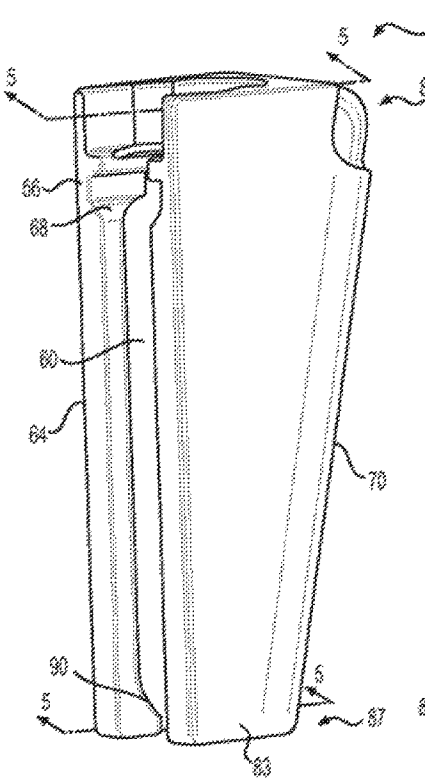

An exemplary embodiment of wedge 28 is shown in FIGS. 4 and 5. As can be seen in these figures, surfaces 64 and 70 together form a wedge-shaped body 83 therebetween that has a base end 85 wider than a tip end 87. As described above, base end 85 may receive the head of fastener 32, while tip end 87 may receive the shank of fastener 32 and slider 30 connected thereto. Channel 60 may extend from collar 68 at base end 85 through tip end 87 of body 83. Tip end 87 may be received first through apertures 42 and 44 during assembly of system 20.

An elongated pocket 84 may be formed in tip end 87 of body 83 that is communication with a lower end of channel 60 (i.e., an end opposite collar 68). Pocket 84, in the disclosed embodiment, has a curved inner surface 82 with a longitudinal axis 86 that is generally parallel with and offset from an axis 88 of channel 60. In this same embodiment, pocket 84 may have a circular cross-section with a radius about (e.g., within manufacturing tolerances) equal to a radius of channel 60. The offset distance between axis 86 and 88 may be about equal to ⅓ to ½ of the radius of pocket 84 and channel 60.

As will be described in more detail below, pocket 84 may function to increase a volume and depth of channel 60. When slider 30 is moved away from collar 68 toward the distal end of channel 60 and into pocket 84, toothed surface 78 of slider 30 may be allowed to drop out of meshed engagement with teeth 74 of clamp 26. This may be helpful during assembly of wedge 28, allowing wedge 28 to be inserted a greater distance through apertures 42, 44 before engagement of toothed surface 78 with teeth 74. By inserting wedge 28 further into opening 40 before teeth 74 of clamp 26 become locked with toothed surface 78 of slider 30, a greater number of teeth may engage each other for greater strength in the engagement. In addition, the technician may not be required to rotate fastener 32 as much to achieve the desired level of engagement.

In some situations, gravity may tend to urge slider 30 into engagement with clamp 26, even though the volume and depth exists within pocket 84 to allow disengagement of slider 30. For this reason, a ramp 90 may be formed at the distal end of pocket 84 near tip end 87. Ramp 90 may have an inner surface that is inclined relative to axis 86, such that a lower or outer portion of ramp 90 is located closer to axis 86 than an upper or inner portion. In one example, the inner surface of ramp 90 is oriented at an angle $\alpha$ of about 15-30° (e.g., about 22°, within engineering tolerances) relative to axis 86 and protrudes from surface 62 inward through channel 60 toward pocket 84. With this configuration, a loosening rotation of fastener 32 may push slider 30 downward away from collar 68 until a lower end of slider 30 engages ramp 90. Further loosening rotations at this time will drive slider 30 into the ramped inner surface, forcing slider 30 into pocket 84 and completely out of engagement with clamp 26. When this happens, wedge 28 may be removed from apertures 42 and 44 with slider 30 still connected to fastener 32. This may reduce the amount of loosening rotation that must occur during disassembly, and also help reduce a likelihood of slider 30 being dropped and lost.

A similar ramp 92 may be formed at the upper or inner end of pocket 84 opposite ramp 90, in some embodiments. Ramp 92 may be generally parallel with the inclined surface of ramp 90, and protrude outward from the curved surface of channel 60 toward pocket 84. Ramp 92 may function to reposition slider 30 back into channel 60 (and back into engagement with clamp 26) during tightening rotations of fastener 32.

Pocket 84 should be sized to fully receive slider 30 between ramps 90 and 92. That is, a distance $d_1$ along axis 86 of a straight-walled section of pocket 84 should be greater than a length of slider 30. In one embodiment, this distance $d_1$ is about ¼ to ½ (e.g., about ⅓) of a distance D between the lower surface of collar 68 and tip end 87 of body 83. In addition, a depth $d_2$ of pocket 84 (i.e., a distance between surface 64 and a furthest point on the curvature of pocket 84) should be greater than a height of slider 30 (i.e., greater than a distance from the peaks of toothed surface 78 to an opposing surface of slider 30). In this way, when slider 30 is fully within pocket 84, surface 64 of wedge 28 may lie directly on surface 62 of clamp 26 with clearance between opposing tooth peaks.

INDUSTRIAL APPLICABILITY

The disclosed tool retention system may be applicable to various earth-working machines, such as rope shovels, hydraulic mining shovels, excavators, wheel loaders, draglines, dredges, and bulldozers. Specifically, the tool retention system may be used to removably connect ground engaging tools to the work implements of these machines. In this manner, the disclosed retention system may help to protect the work implements against wear in areas experiencing damaging abrasions and impacts. Use of tool retention system 20 to connect GET 14 to work implement 12 will now be described in detail.

To connect a particular GET 14 to work implement 12, for example to connect tooth assembly 14*a* to cutting edge 16, a service technician may first position legs 38 of tooth assembly 14*a* over opposing surfaces of cutting edge 16 so that apertures 42 are generally aligned with aperture 44 of work implement 12. Clamp 26 and a subassembly, consisting of wedge 28, slider 30, and fastener 32, may then be inserted through apertures 42 and 44, with arms 52 of clamp 26 facing rearward away from end 24 of tooth assembly 14*a*. Inner surfaces of arms 52 may engage the opposing surfaces of implement 12 at apertures 42. The subassembly may be positioned in front of clamp 26, with surface 64 located adjacent surface 62 inside of apertures 42 and 44. Slider 30, at this point in time, may be located within pocket 84.

Once the above-described clamp and subassembly are in place, the service technician may push the subassembly as far as possible through apertures 42 and 44, and then begin to rotate fastener 32 to tighten the connection between work implement 12 and tooth assembly 14*a*. Specifically, as the service technician drives fastener 32 into slider 30 (e.g., by a clockwise rotation of the head of fastener 32), slider 30 may be drawn upward toward collar 68. At some point during this upward movement, an upper edge of slider 30 may engage ramp 92, urging slider 30 out of pocket 84 and into channel 60. As slider 30 moves from pocket 84 into channel 60, toothed surface 78 may emerge from wedge 28 and move toward clamp 26. Soon thereafter, toothed surface 78 of slider 30 may interlock with teeth 74 of clamp 26, causing wedge 28 to advance further into apertures 42 and 44. Because of the tapered shape of wedge 28, the advancement of wedge 28 may force clamp 26 away from wedge 28. And as clamp 26 moves away from end 24 of tooth assembly 14*a*, a greater clamping force may be exerted on legs 38 of tooth assembly 14*a*. This force may function to clamp implement 12 between legs 38 and hold GET 14 in place during operation of machine 10. The subassembly of wedge 28, slider 30, and fastener 32 may facilitate simple and quick connection of GET 14 with work implement 12 in the field.

To disassemble retention system 20, fastener 32 may be rotated in a counterclockwise direction. As fastener 32 is rotated in the counterclockwise direction, slider 30 may be pushed downward within channel 60. Eventually, slider 30 may move downward far enough so that a lower edge of slider 30 engages ramp 90. Further counterclockwise rotation at this time may urge slider 30 out of channel 60 and into pocket 84. As slider 30 moves from channel 60 into pocket 84, toothed surface 78 may disengage from clamp 26 and retreat into wedge 28. As toothed surface 78 disengages from teeth 74 of clamp 26, wedge 28 may become free to move. Thereafter, wedge 28 may be tapped or pulled out of apertures 42, 44.

The disclosed retention system may be simple to install and remove. In particular, the disclosed pocket 84 may force engagement and disengagement of slider 30 from clamp 26, when desired. This functionality may allow for greater wedge insertion before the use of fastener 32 is required, thereby providing for a more secure engagement. In addition, the same functionality may allow for unrestricted removal of wedge 28.

It will be apparent to those skilled in the art that various modifications and variations can be made to the disclosed retention system. Other embodiments will be apparent to those skilled in the art from consideration of the specification and practice of the disclosed retention system. It is intended that the specification and examples be considered as exemplary only, with a true scope being indicated by the following claims and their equivalents.

What is claimed is:

1. A wedge for a tool retention system, comprising:

a body having a tip end and an opposing base end that is wider than the tip end;

a channel formed in the body and extending from the base end to the tip end;

an elongated pocket formed in the body at the tip end that is open to the channel; and a ramp located in the body and extending between the channel and an end of the elongated pocket, the ramp being inclined relative to an axis of the channel, wherein the ramp is located at the tip end of the body and protrudes inward from a channel inner surface toward the elongated pocket, and wherein the ramp is a first ramp; and the wedge further includes a second ramp located at a point between the base end of the body and the first ramp, the second ramp protruding outward from a curved surface of the channel toward the elongated pocket.

2. The wedge of claim 1, wherein:

the body has a curved outer surface extending from the base end to the tip end, and a flat outer surface located opposite the curved outer surface;

the channel is open along its length to the flat outer surface; and the elongated pocket is located between the channel and the curved outer surface.

3. The wedge of claim 1, further including a collar dividing the channel into a fastener head section and a fastener shank section.

4. The wedge of claim 3, wherein a straight-walled length of the elongated pocket is about ¼ to ½ of a length of the channel from the collar to the tip end of the body.

5. The wedge of claim 4, wherein the straight-walled length of the elongated pocket is about ⅓ of the length of the channel from the collar to the tip end of the body.

6. The wedge of claim 1, wherein the channel and the elongated pocket have internal curved surfaces with about the same radiuses.

7. The wedge of claim 6, wherein an axis of the elongated pocket is parallel with the axis of the channel.

8. The wedge of claim 7, wherein an offset distance between the axis of the elongated pocket and the axis of the channel is about equal to ⅓ to ½ of the radiuses of the elongated pocket and channel.

9. The wedge of claim 1, wherein an angle of first ramp relative to the axis of the channel is about the same as an angle of the second ramp relative to the axis of the channel.

10. The wedge of claim 9, wherein the angles of the first and second ramps are about 15-30°.

11. The wedge of claim 10, wherein the angles of the first and second ramps are about 22°.

12. A system for retaining a tool connected to an implement, comprising:

a clamp configured to pass through openings in the implement and tool and having:

a first side configured to engage the implement and the tool; and a second side with teeth oriented away from the implement and the tool;

a wedge configured to pass through the openings in the implement and the tool, and having:

a body with a flat outer surface configured to engage the second side of the clamp and extending between a tip end and an opposing base end that is wider than the tip end, and a curved outer surface located opposite the flat outer surface and configured to engage the implement and the tool;

a channel formed in the body and extending from the base end to the tip end;

a collar dividing the channel into a head section and a shank section;

an elongated pocket formed in the body at the tip end that is open to the shank section of the channel;

a first ramp located in the body and extending between the channel and an end of the elongated pocket, the first ramp being inclined relative to an axis of the channel; and a second ramp located at a point between the base end of the body and the first ramp, the second ramp being inclined relative to the axis of the channel;

a slider configured to move between the channel and the elongated pocket and having a toothed surface configured to engage the teeth of the clamp when the slider is in the channel; and a fastener having a head located in the head section of the channel and a shank located in the shank section of the channel and threadingly engaged with the slider.

13. The system of claim 12, wherein:

the channel is open along its length to the flat outer surface of the body; and the elongated pocket is located between the channel and the curved outer surface of the body.

14. The system of claim 12, wherein a straight-walled length of the elongated pocket is about ⅓ of a length of the shank section of the channel.

15. The system of claim 12, wherein:

the channel and the elongated pocket have internal curved surfaces with about the same radiuses; and an axis of the elongated pocket is parallel with the axis of the channel.

16. The system of claim 15, wherein an offset distance between the axis of the elongated pocket and the axis of the channel is about equal to ⅓ to ½ of the radiuses of the elongated pocket and channel.

17. The system of claim 12, wherein:

the first ramp protrudes inward from a channel inner surface toward the elongated pocket; and the second ramp protrudes outward from a curved surface of the channel toward the elongated pocket.

18. The system of claim 17, wherein:

an angle of first ramp relative to the axis of the channel is about the same as an angle of the second ramp relative to the axis of the channel; and the angles of the first and second ramps are about 22°.

* * * * *